US009743723B2

(12) United States Patent
Chang et al.

(10) Patent No.: US 9,743,723 B2
(45) Date of Patent: Aug. 29, 2017

(54) ONE-PIECE ZIPPER PULLER

(75) Inventors: Chwan Huey Lim Chang, Long Grove, IL (US); David A. Shereyk, Homewood, IL (US); John S. Pontaoe, Chicago, IL (US); Tun-Jen Chu, Plainfield, IL (US); Timothy P. Coffield, Grand Rapids, MI (US)

(73) Assignee: Illinois Tool Works Inc., Glenview, IL (US)

( * ) Notice: Subject to any disclaimer, the term of this patent is extended or adjusted under 35 U.S.C. 154(b) by 119 days.

(21) Appl. No.: 13/984,797

(22) PCT Filed: Feb. 10, 2012

(86) PCT No.: PCT/US2012/024616

§ 371 (c)(1),
(2), (4) Date: Aug. 9, 2013

(87) PCT Pub. No.: WO2012/109521

PCT Pub. Date: Aug. 16, 2012

(65) Prior Publication Data

US 2013/0312230 A1 Nov. 28, 2013

Related U.S. Application Data

(60) Provisional application No. 61/442,051, filed on Feb. 11, 2011.

(51) Int. Cl.
*A44B 19/26* (2006.01)
*A44B 19/42* (2006.01)

(52) U.S. Cl.
CPC ..... *A44B 19/262* (2013.01); *A44B 19/42* (2013.01); *Y10T 24/2586* (2015.01)

(58) Field of Classification Search
CPC .. A47C 5/12; A47C 7/14; A47C 7/282; A47C 7/287; A47C 7/746; F16F 1/36; F16F 2226/00; Y10T 428/24719; Y10T 428/24975
USPC ..... 24/429; 294/3.6
See application file for complete search history.

(56) References Cited

U.S. PATENT DOCUMENTS 4,873,750 A * 10/1989 Tracy ..... A44B 19/262 24/429
5,101,538 A * 4/1992 Dieter ..... A44B 19/262 24/421
5,187,841 A * 2/1993 Takemura ..... A44B 19/262 24/415

(Continued)

FOREIGN PATENT DOCUMENTS

DE 3444813 A1 6/1986
FR 278537 A1 6/2000

OTHER PUBLICATIONS

Corresponding International Application PCT/US2012/024616 Search Report dated Jun. 6, 2012.

*Primary Examiner* — David Upchurch
(74) *Attorney, Agent, or Firm* — Joseph M. Butscher; The Small Patent Law Group, LLC

(57) ABSTRACT

A zipper puller (110) has a one piece structure including a molded plastic body (112) and an integral molded looped tether (114). The looped tether is molded in a first size and shape, and after molding the looped tether is permanently deformed to a second size and second shape by aligning the crystalline structure of the looped tether material.

12 Claims, 5 Drawing Sheets

(56) References Cited

U.S. PATENT DOCUMENTS

| | | | | | |
|---|---|---|---|---|---|
| 5,347,692 | A * | 9/1994 | Ebata | A44B 19/262 | 24/419 |
| 5,690,444 | A * | 11/1997 | Yuuki | A44B 19/262 | 24/429 |
| 5,771,546 | A * | 6/1998 | Minato | A44B 19/262 | 24/419 |
| 5,911,369 | A * | 6/1999 | Yamazaki | A44B 19/262 | 24/419 |
| 5,930,874 | A * | 8/1999 | Yamazaki | A44B 11/10 | 24/419 |
| 7,200,901 | B2 * | 4/2007 | Pitts | A44B 19/262 | 24/436 |
| 7,441,758 | B2 * | 10/2008 | Coffield | A47C 5/12 | 267/142 |
| 8,225,465 | B2 * | 7/2012 | Honeycutt | H04R 5/0335 | 24/405 |
| 2005/0050698 | A1 * | 3/2005 | Muratsubaki | A44B 19/262 | 24/429 |
| 2006/0267258 | A1 | 11/2006 | Coffield et al. | | |
| 2007/0124901 | A1 * | 6/2007 | Cyr | A44B 19/262 | 24/429 |
| 2009/0265899 | A1 * | 10/2009 | Yang | A44B 19/262 | 24/429 |
| 2014/0345092 | A1 * | 11/2014 | Shereyk | A44B 19/262 | 24/429 |

* cited by examiner

ONE-PIECE ZIPPER PULLER

CROSS-REFERENCE TO RELATED APPLICATIONS

The present application claims the benefits of U.S. Provisional application Ser. No. 61/442,051; filed Feb. 11, 2011.

FIELD OF THE INVENTION

The present invention relates generally to zippers, and more particularly to attachments that are provided for the handles of the zippers to provide a larger, more easily grasped article by which to pull a zipper for zipping or unzipping.

BACKGROUND OF THE INVENTION

Standard zippers used on clothing, personal articles such as backpacks, shoulder bags, luggage and other things have relatively small handles or tabs by which the zipper is operated for closing (zipping) or opening (unzipping). Even on a large zipper, such as those found on suitcases, the handle or tab can be relatively small and difficult to grasp securely. Frequently made of metal, the handle is often smooth and can be somewhat slippery. Zippers are often concealed, with fabric overlapping the zipper along each side of the zipper. In such arrangements, the handle can be difficult to locate and dislodge from beneath the fabric edges. In heavily packed articles, tension on the zipper can make it difficult to operate, and the small surface of the handle can be inadequate to grip securely for operating the zipper.

It is known to provide zipper pullers of various types attached to the zipper handle to provide a larger, more easily grasped article by which to operate the zipper. The zipper handle commonly has a hole near the end thereof, and known configurations of zipper pullers are attached by looping, tying or otherwise securing the puller through the hole in the handle. A pliable portion along with a knob, knot or other enlargement provides a more readily graspable article by which the zipper can be operated.

In a simple form, a zipper puller may be an elongated piece of nylon or other fabric tied or looped through the hole in the zipper handle. While fabric secured in this manner provides a longer structure than the zipper handle alone by which to grasp and operate the zipper, the smooth, thin fabric can sometimes be difficult to grasp as well. More advantageously, a zipper puller has an enlarged or bulbous end or portion more easily grasped than the relatively thin zipper handle. Known zipper pullers of this type have been two piece articles, including a string, cord or the like serving as a tether between the zipper handle and a larger body end piece attached to the tether. While two-piece zipper pullers of this type have performed somewhat adequately for the purpose intended, the two-piece zipper puller can be costly to manufacture and install. Further, the string, cord or other tether portion can stretch or otherwise change, or even break, making the zipper puller nonfunctional, even if not lost completely. More elastic tethers have been used but tend to act more like a rubber band, being too springy to transmit the load from the user to the zipper handle.

It is known that a body of thermoplastic elastomer can be processed to align the crystalline structure thereof to a permanently deformed thinner shape having increased flexibility while maintaining the strength of a thicker, more robust and less flexible body. The process has been referred to as "orienting" and can be found described in U.S. Pat. No. 7,441,758 and United States Patent Application Publication 2006/0267258; which are incorporated herein by reference.

SUMMARY OF THE INVENTION

A robust, one-piece zipper puller is disclosed herein which can be manufactured easily by known molding processes, yet does not have the same disadvantages of known zipper pullers.

An advantage of at least one form of the zipper pullers disclosed herein is that a complete zipper puller is molded in an injection molding tool in one piece, thereby eliminating the time and expense required for assembling previously known zipper pullers.

Another advantage of at least one form of the zipper pullers disclosed herein is that the zipper puller can be molded in readily moldable sizes and shapes, and thereafter processed to meet or exceed flexibility, strength and size requirements that might otherwise be difficult to achieve by standard molding processes.

Still another advantage of at least one form of the zipper pullers disclosed herein is that the zipper puller offers flexibility, high strength and tuned stretch in a one-piece molded structure.

Other features and advantages of the invention will become apparent to those skilled in the art upon review of the following detailed description, claims and drawings in which like numerals are used to designate like features.

Figure 1:
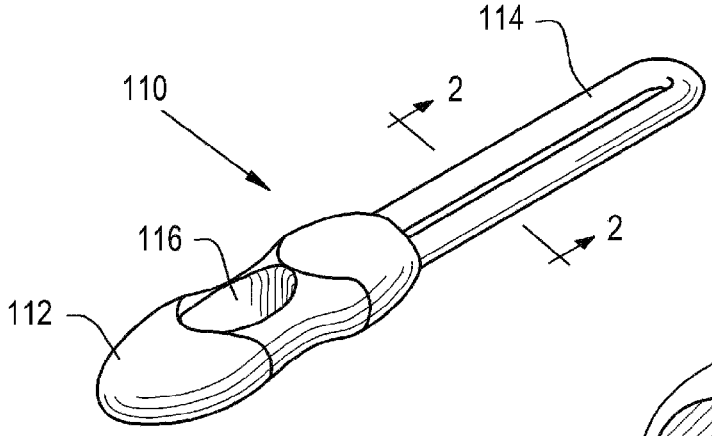
FIG. 1 is a perspective view of a one-piece zipper puller.

Before the embodiments of the invention are explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein are for the purpose of description and should not be regarded as limiting. The use herein of "including", "comprising" and variations thereof is meant to encompass the items listed thereafter and equivalents thereof, as well as additional items and equivalents thereof.

DETAILED DESCRIPTION OF THE PREFERRED EMBODIMENT

Figure 2:
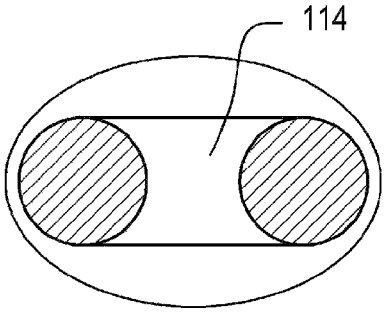
FIG. 2 is a cross-sectional view of the one-piece zipper puller shown in FIG. 1, taken on line 2-2 of FIG. 1.
Figure 3:
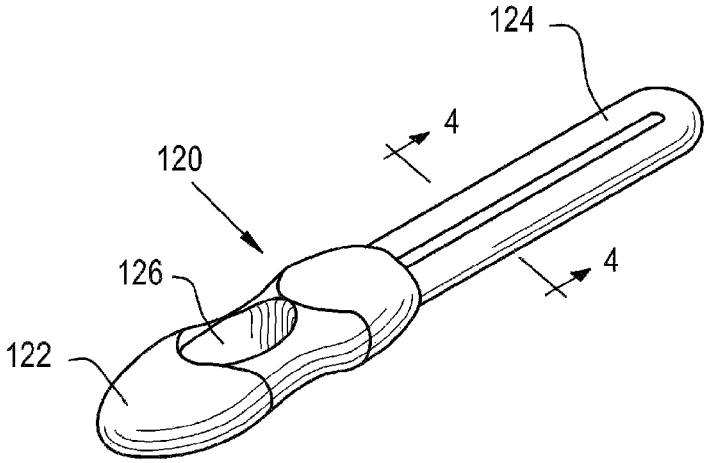
FIG. 3 is a perspective view of a second embodiment of a one-piece zipper puller.
Figure 4:
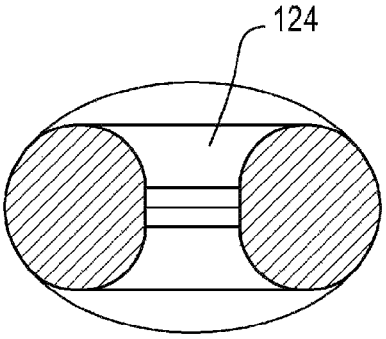
FIG. 4 is a cross-sectional view of the one-piece zipper puller shown in FIG. 3, taken on line 4-4 of FIG. 3.
Figure 5:
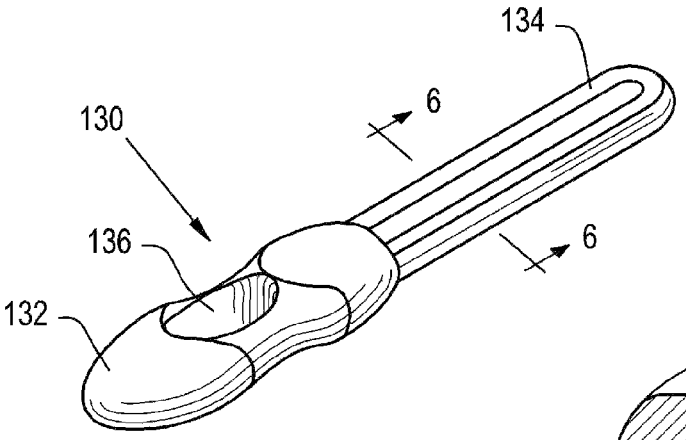
FIG. 5 is a perspective view of another embodiment of a one-piece zipper puller.
Figure 6:
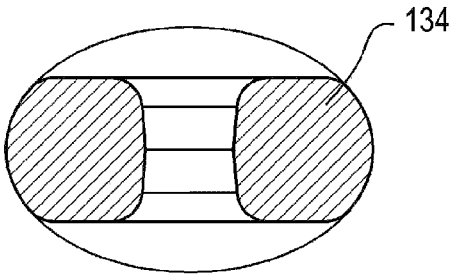
FIG. 6 is a cross-sectional view of the one-piece zipper puller shown in FIG. 5, taken on line 6-6 of FIG. 5.
Figure 7:
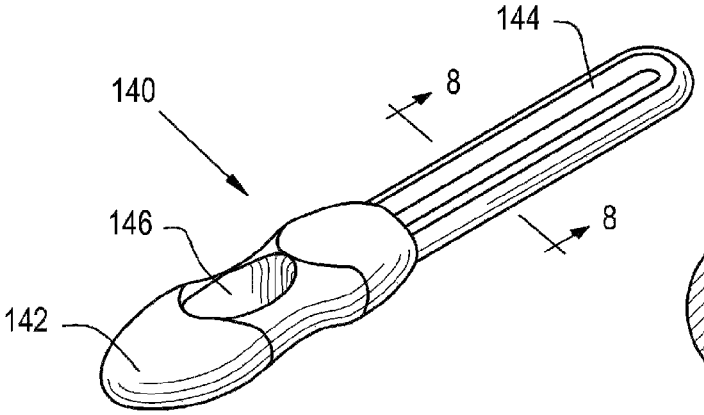
FIG. 7 is a perspective view of still another embodiment of a one-piece zipper puller.
Figure 8:
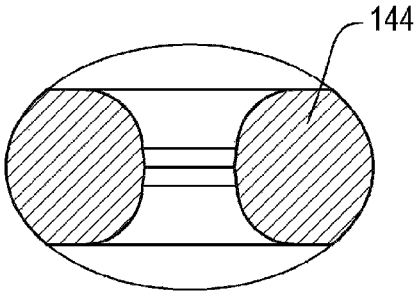
FIG. 8 is a cross-sectional view of the one-piece zipper puller shown in FIG. 7, taken on line 8-8 of FIG. 7.
Figure 9:
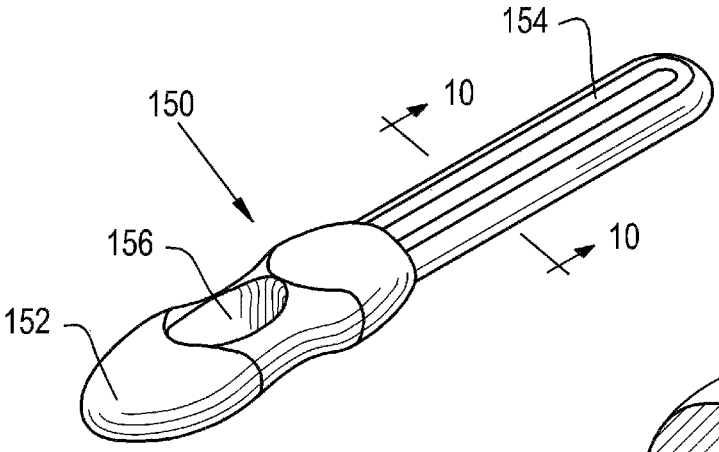
FIG. 9 is a perspective view of yet another embodiment of a one-piece zipper puller.
Figure 10:
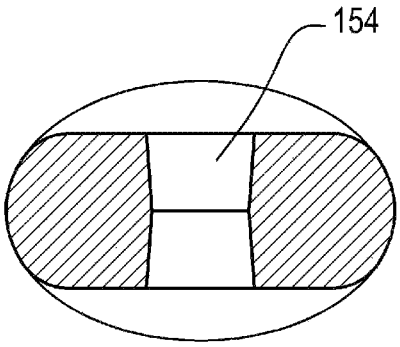
FIG. 10 is a cross-sectional view of the one-piece zipper puller shown in FIG. 9, taken on line 10-10 of FIG. 9.
Figure 11:
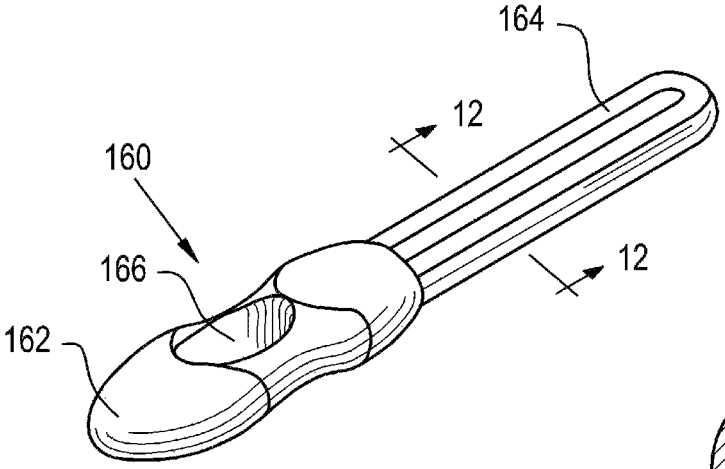
FIG. 11 is a perspective view of a further embodiment of a one-piece zipper puller.
Figure 12:
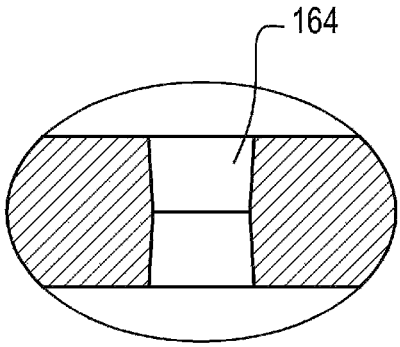
FIG. 12 is a cross-sectional view of the one-piece zipper puller shown in FIG. 11, taken on line 12-12 of FIG. 11.
Figure 13:
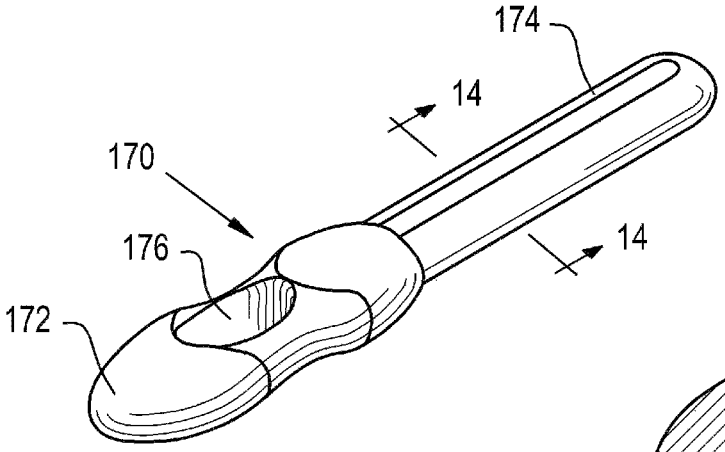
FIG. 13 is a perspective view of a yet further embodiment of a one-piece a zipper puller.
Figure 14:
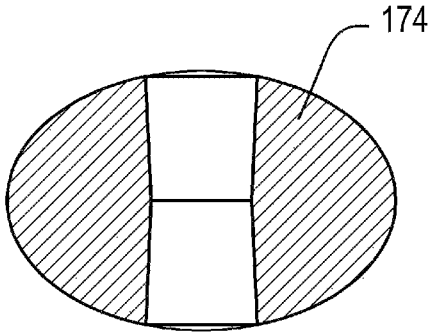
FIG. 14 is a cross-sectional view of the one-piece of zipper puller shown in FIG. 13, taken on line 14-14 of FIG. 13.

Referring now more specifically to the drawings, a zipper puller 110 is shown in FIGS. 1 and 2. Zipper puller 110 is a one-piece article having a grasping body 112 and a looped tether 114. Looped tether 114 is a loop of sufficient length that it can be inserted through a hole in a zipper handle, with body 112 then passed through the distal end of the loop to secure tether 114 on the zipper handle, in known fashion. Body 112 can have any of a variety of shapes and in the exemplary embodiment of FIGS. 1, 3, 5, 7, 9, 11 and 13 has a generally hourglass shape for easy grasping. However other shapes can be used, including more simple geometric shapes such as a rectangle, sphere, triangle, etc., or even artistic designs such as logos and the like of manufacturers of the article on which zipper puller 110 is used.

Zipper puller 110 is made of injection molded plastic. Body 112 and looped tether 114 are made from the same material. To perform well for its intended purpose, looped tether 114 must be strong to resist breaking and transmit forces to the zipper handle, yet flexible to be looped through a zipper handle and secured on the zipper as described above. Thermoplastic elastomer is used for zipper puller 110. Looped tether 114 is subjected to a post-molding process to refine the strength and flexibility required. If a loop of about 1.0-1.5 mm diameter is molded at sufficient length (such as approximately 40.0 mm) the form can be hard to fill in a mold and may not meet the required tensile load for the puller. Processing by orienting can provide looped tether 114 with different load bearing characteristics in different directions.

Generally in the manufacture of zipper puller 110, a larger diameter shorter length loop than what is required for final use is molded. For example and not limitation, a loop of 2.0-4.0 mm diameter having a length of 10.0-20.0 mm may be used. In the orientation process, the crystalline structure of looped tether 114 is aligned in the direction of its length to both increase the length and decrease the thickness of the looped tether material as molded. For example and not limitation, from an as-molded size of approximately 2.0 mm diameter and approximately 25.0 mm length, looped tether 114 is permanently deformed to about 1.0-1.5 mm diameter and a length of approximately 40.0 mm. Processing by orienting is performed to align the crystalline structure of the loop portion along the axis of tensile loading to increase the length of the loop to the required dimension and improve the characteristics of the molded loop, such as flexibility for attachment. By strengthening the loop through the orienting process to the proper diameter and length, a one-piece zipper puller can be provided with the required characteristics.

The process conditions for orienting can be varied to achieve desired results and physical characteristics of an oriented product. Generally speaking, looped tether 114 is oriented, whereas body 112 is not.

Zipper puller 110 may be manufactured from essentially elastomeric material capable of being oriented to provide the desired characteristics. For example, zipper puller 110 may be a thermoplastic elastomer, polyester, nylon-based TPE or a thermoplastic urethane. A variety of alternative elastomers may be suitable for use in the present invention. The thickness of zipper puller 110 can vary from application to application, depending on conditions in which it will be used and desired performance characteristics, such as, for example, the anticipated tensile load to be applied and the desired stiffness or flexibility of looped tether 114. Accordingly, the as molded size and shape of the looped tether can differ to achieve the desired result after processing for orienting.

After zipper puller 110 is formed by molding, looped tether 114 is oriented to give it the desired physical characteristics. In the orienting process, for example, tether 114 may be intentionally and permanently deformed such as by alignment of the crystalline structure in the direction along which the principle tensile loads will be applied during use (i.e. to elongate looped tether 114). By orienting in this way prior to actual use, undesired deformation, referred to as "creep", that might otherwise occur during use can be limited and potentially avoided altogether. In anticipation of orienting, zipper puller 110 is intentionally designed for an as "molded size" that is shorter but thicker than the required "in use" size by the amount that it will be altered by the permanent deformation brought on during the orienting process. The precise method and manner of orienting looped tether 114 of zipper puller 110 may vary from application to application and may differ depending in part on the intended use and final characteristic of zipper puller 110. A single act of stretching looped tether 114, repeated acts of stretching under the same or different conditions and/or compression by hammering or pressing are all examples of some suitable orienting processes. Acts of bending around a curved surface, such as a mandrel; or twisting while stretching can be used to develop permanently curved or rotated shapes in looped tether 114.

While a one shot process for molding has been disclosed, it is anticipated that a two shot process also can be used to mold the loop and base in different colors, for example, but as a single monolithic structure. Customized loop colors similar to customized nylon cord pullers can be provided. Still other features can be included. For example, the body portion can be provided with a hole 116 for decorative or functional inserts, labeling, indicia, or the like. In one potentially advantageous embodiment, a magnet is provided in hole 116 of body 112. Still other variations can be provided.

FIGS. 3-14 show other zipper pullers 120, 130, 140, 150, 160 and 170, respectively, having bodies 122, 132, 142, 152, 162 and 172, respectively that are molded plastic similar to body 112. Looped tethers 124, 134, 144, 154, 164 and 174 are molded integrally with bodies 122, 132, 142, 152, 162 and 172, as described above with respect to body 112 and looped tether 114. Holes 126, 136, 146, 156, 166 and 176 can be provided for receiving decorative or functional inserts.

Looped tethers 124, 134, 144, 154, 164 and 174 can be provided of different sizes and cross-sectional shapes to achieve different desired final characteristics in the oriented product. As can be seen, the as molded shapes of looped tethers 124, 134, 144, 154, and 164 are not round, and if provided with major diameters of between about 2.3 and 2.6 mm the cross-sectional areas thereof will be greater than that of the substantially round shape of looped tether 114 provided at about 2.0 mm diameter; and the final processed looped tethers 124, 134, 144, 154, and 164 are somewhat stronger than the final processed strength of looped tether 114. The as molded shape of looped tether 174 can be provided with an even greater cross-sectional area, and if provided with a major diameter of about 3.8 mm the final processed looped tether 174 may have about twice the strength of looped tether 114.

Figure 15:
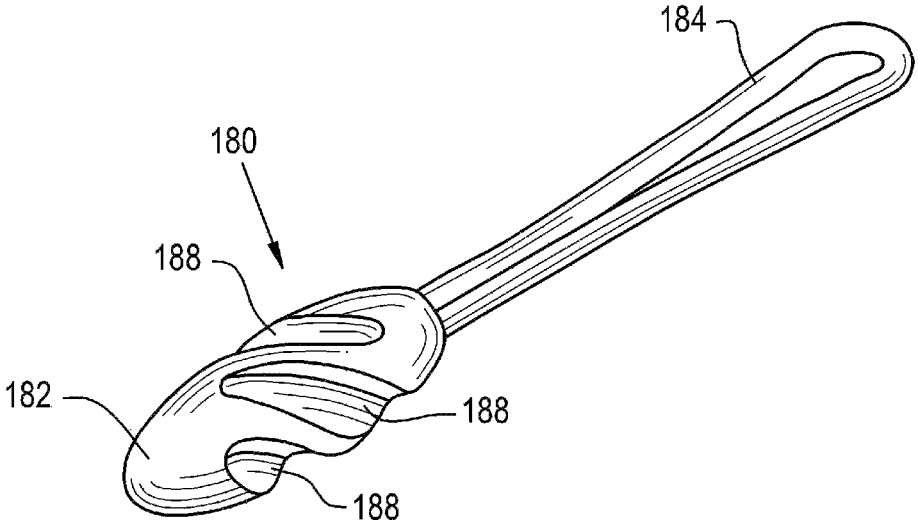
FIG. 15 is a perspective view of a still further embodiment of a one-piece zipper puller.

FIG. 15 illustrates a zipper puller 180 having a body 182 and a looped tether 184 integral therewith. Looped tether 184 is shown in an after processing condition, being both elongated and thinned from its as molded form. Body 182 is provided with heavy valleys 188 in the surface thereof for improved grip during use.

Figure 16:
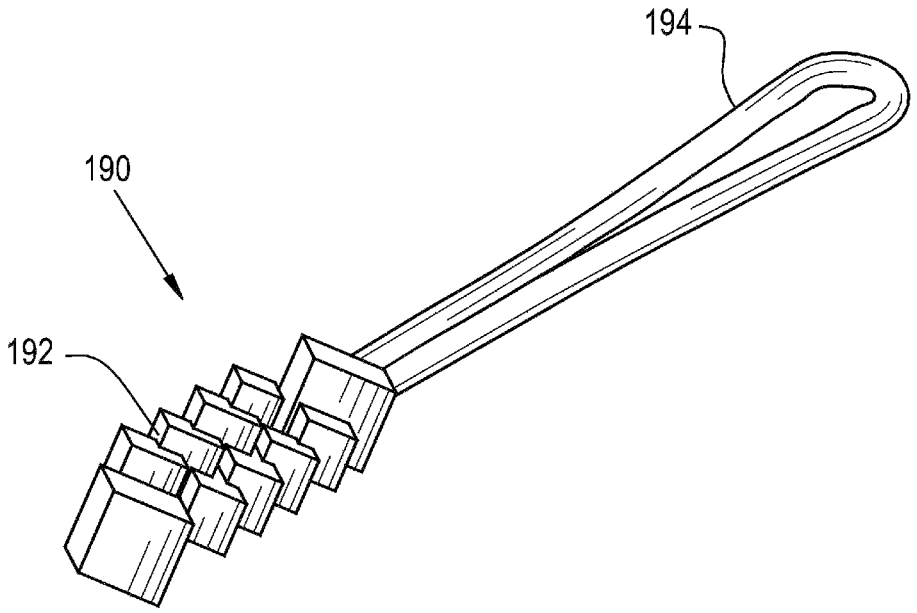
FIG. 16 is a perspective view of an additional embodiment of a one-piece zipper puller.

FIG. 16 illustrates a zipper puller 190 having a body 192 and a looped tether 194 integral therewith. Looped tether 194 is shown in an after processing condition, being both elongated and thinned from its as molded form. Body 192 is provided with the appearance of an arrangement of distinct geometric shapes that are both decorative and functional to improve grip. Still other types of surface roughening or treatment can be used to improve grip and reduce slippage, and/or for aesthetic purposes.

Figure 17:
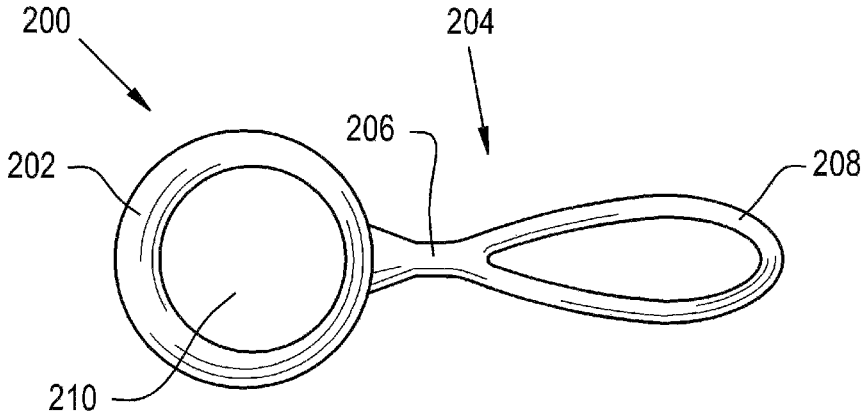
FIG. 17 is a perspective view of still another embodiment of a one-piece zipper puller.

FIG. 17 illustrates a zipper puller 200 having a body 202 and a looped tether 204 integral therewith. Relative to body 202, looped tether 204 includes a proximal solid rib portion 206 and a distal loop portion 208. Rib portion 206 can be processed along with loop portion 208 to alter the characteristics thereof. In some applications and uses, it may be adequate to leave rib portion 206 in an unprocessed condition, as with body 202. Body 202 as shown defines a hole 210, but can be solid and/or of other shapes.

Variations and modifications of the foregoing are within the scope of the present invention. It is understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention. The claims are to be construed to include alternative embodiments to the extent permitted by the prior art.

Various features of the invention are set forth in the following claims.

What is claimed is:

1. A one-piece zipper puller to suspend from a hole in a zipper handle, comprising:

a single, integrally-formed elastomeric puller body having a puller body crystalline structure;

an elastomeric tether integral with said puller body, said tether formed and molded as an endless loop having a length extending from said puller body;

said endless loop having flexibility along said length sufficient for said puller body to pass through a distal end portion of said endless loop with said endless loop received in the hole of the zipper handle;

said tether having a crystalline structure aligned in the direction of said length; and said crystalline structure of said tether being more aligned than the crystalline structure of said puller body.

2. The one-piece zipper puller of claim 1, said tether and said body being of the same elastomeric material.

3. The one-piece zipper puller of claim 1, said tether and said body being a monolithic structure of different materials.

4. The one-piece zipper puller of claim 1, said body including a hole for receiving an insert.

5. The one-piece zipper puller of claim 1, said body provided with a grip enhancing surface configuration.

6. The one-piece zipper puller of claim 1, said tether including a proximal solid rib portion and a distal loop portion.

7. A method for manufacturing a zipper puller to suspend from a hole in a zipper handle, including steps of:

molding a zipper puller body and an endless looped tether integral with the zipper puller body as a one-piece molding, said endless looped tether having molded thickness, length, flexibility and strength, wherein said step of molding comprises integrally forming and molding the zipper puller body as a single unitary piece; and processing the endless looped tether to align the crystalline structure thereof by permanently deforming the endless looped tether from its as molded thickness, length and flexibility to a decreased thickness, increased length and increased flexibility;

said step of processing performed to achieve a desired strength along the length of the endless looped tether different from the strength of the endless looped tether as molded; and said step of processing performed to increase the length, strength and flexibility sufficiently for said zipper puller body to pass through a distal end of said endless looped tether with said endless looped tether received in the hole of the zipper handle.

8. The method of claim 7, said step of processing including stretching.

9. The method of claim 7, said step of processing including pressing.

10. The method of claim 7, said step of processing performed to achieve a desired flexibility in the looped tether different than the flexibility in the looped tether as molded.

11. A one-piece zipper puller, comprising:

a single, integrally-formed elastomeric puller body having a first elastomeric crystalline structure;

an elastomeric tether integral with said puller body;

said tether defining an endless loop having a length extending from said puller body, said endless loop being of sufficient size and flexibility to be doubled back on itself and receive said puller body passed through said loop; and said tether having a second elastomeric crystalline structure different from said first elastomeric crystalline structure.

12. The one-piece zipper puller of claim 11, said tether having a crystalline structure aligned in the direction of said length.

* * * * *